US005544370A

United States Patent [19]

Götter et al.

[11] Patent Number: 5,544,370

[45] Date of Patent: Aug. 13, 1996

[54] BUILT-IN SINK

[75] Inventors: Hans Götter, Sulzfeld; Manfred Mück, Kürnbach; Thomas Wilhelm, Sulzfeld, all of Germany

[73] Assignee: Blanco GmbH & Co. KG, Oberderdingden, Germany

[21] Appl. No.: 256,890

[22] PCT Filed: Jan. 20, 1993

[86] PCT No.: PCT/EP93/00115

§ 371 Date: Jan. 12, 1995

§ 102(e) Date: Jan. 12, 1995

[87] PCT Pub. No.: WO93/15282

PCT Pub. Date: Aug. 5, 1993

[30] Foreign Application Priority Data

Jan. 30, 1992 [DE] Germany ..... 42 02 517.6

[51] Int. Cl.[6] ..... A47K 1/04

[52] U.S. Cl. ..... 4/619

[58] Field of Search ..... 4/538, 619, 580, 4/584

[56] References Cited

U.S. PATENT DOCUMENTS 3,918,377 11/1975 Herbold ..... 72/349

FOREIGN PATENT DOCUMENTS 0229262 11/1986 European Pat. Off. ..... 4/619

*Primary Examiner*—Charles E. Phillips

*Attorney, Agent, or Firm*—Fitch, Even, Tabin & Flannery

[57] ABSTRACT

A built-in sink unit with at least one basin, which has first surface areas, such as the bottom of the basin, subject to severe wear during use as well as second surface areas, such as the side walls of the basin, subject to less severe wear during use and in which the first surface areas are provided with a three-dimensional surface structure and the second surface areas are smooth. To ensure that any surface damage in the region of the surface areas subject to severe wear during use does not immediately catch the eye, the built-in sink unit gives the optical impression, when new, of really being a new article and the sink unit can, finally, be cleaned effectively with abrasive means without any disadvantageous optical effects thereby resulting, the surface structure of the first areas is formed by microgrooves at least approximately straight and extending parallel to one another, the surface roughness measured transversely to the longitudinal direction of the microgrooves being greater than 0.1 μm and at the most approximately 0.4 μm.

8 Claims, 2 Drawing Sheets

BUILT-IN SINK

FIELD OF THE INVENTION

The invention relates to a built-in sink unit with at least one basin, which has first surface areas, such as the bottom of the basin, subject to severe wear during use as well as second surfaces areas, such as the side walls of the basin, subject to less severe wear during use and in which the first surface areas are provided with a three-dimensional surface structure and the second surface areas are smooth.

BACKGROUND OF THE INVENTION

Built-in sink units customarily have at least one sink basin and, in addition, a so-called draining surface which is generally provided with longitudinal ribs extending in longitudinal direction of the sink unit, a circumferential, raised rim as well as, if required, a small basin between sink basin and draining surface, namely a so-called scraps basin, and, finally, often at least one raised, plane area for the attachment of a water outlet fitting, namely a so-called base for tap fittings, which borders on the circumferential, raised rim at the front and/or at the back approximately in the center of the built-in sink unit, in particular. The different surface areas of a sink unit, such as a built-in sink unit, are subject to varying degrees of wear during use: The bottom of the sink basin and the upper sides of the ribs of the draining surface are subjected to particularly hard wear by the bottoms of saucepans or pots, cutlery and the like, the bottom of the scraps basin, the upper side of the base or bases for tap fittings and the upper side of the circumferential, raised rim are also subject to severe wear whereas there is scarcely the risk of other surfaces areas, such as the side walls of the basin and the areas of the draining surface lying deeper than the upper sides of the ribs, being damaged, e.g. scratched, during normal use.

For this reason, in the case of built-in sink units produced from casting resin incorporating filler materials and marketed by the company BLANCO GmbH & Co. KG under the trade name SILACRON, the bottoms of the sink basin and scraps basin, the upper sides of the ribs of the draining surface, the bases for tap fittings and the circumferential, raised rim are provided with a knop-like structure while the remaining surface areas of the visible side of this built-in sink unit, e.g. the side walls of the basin, are smooth and therefore have a high-gloss finish when the sink units are new ("smooth" is to be understood as a surface having a surface roughness which is dependent on the size of the filler particles used and in the known sink units as described amounts to approximately 0.1 μm, whereby the so-called cut-off value was 0.8 mm during testing). Owing to this knop-like structure, scratches, for example, in the bottom of the sink basin are hardly noticeable, and the high-gloss surface areas make the sink units really have the appearance, when new, of being a new article. The knop-like structure is, however, disadvantageous when these sink units are cleaned with abrasive means, and sink units which, like these known SILACRON sink units, have a relatively hard surface can only be cleaned effectively when abrasive means are used: In practice, only the area of the knop tips is, in fact, cleaned so that, for example, unavoidable lime deposits between the knops cannot be effectively removed; even greasy or fatty deposits on the bottom of the sink between the knops are far harder to remove than from the smooth side walls of the sink.

The object underlying the invention was to provide sink units, the optical appearance of which, when new, is really that of a new article, with which the appearance of the surface areas subject to severe wear during use is not essentially impaired over a longer period of time and the surface areas which are subject to severe wear during use can be cleaned effectively and thoroughly with abrasive means.

SUMMARY OF THE INVENTION

Proceeding on the basis of a sink unit of the type mentioned at the outset, this object may be accomplished in accordance with the invention in that the surface structure of the first surface areas subject to hard wear during use are formed by microgrooves at least approximately straight and extending parallel to one another, the surface roughness measured transversely to the longitudinal direction of the microgrooves being greater than 0.1 μm and at the most approximately 0.4 μm, while second surface areas subject to less severe wear during use are smooth, whereby the term "smooth" is, where necessary, again to be understood as explained above.

Sink units of this type give the optical impression, when new, of really being a new article not yet used, and it has been shown that the surface areas subject to severe wear during use can be easily and effectively cleaned with abrasive means despite their three-dimensional surface structure, above all when cleaning is carried out in the direction of the microgrooves. The surface areas with their three-dimensional surface structure which are subject to severe wear in use have a satin-frosted appearance, and their appearance is not appreciably impaired by slight damage to the surface, such as scratches.

It has been ascertained that the inventive sink units have a much better appearance even after abrasive cleaning than, for example, sink units which consist of casting resin incorporating filler materials and which were produced by means of a casting mold, the mold cavity wall of which was polished with a rotating polishing disc in first wall surface areas corresponding to the surface areas of the sink unit subject to severe wear during use, above all when the sink units have a hard surface and a considerable color saturation; sink units of this type having "polished" surface areas often look "cloudy" even in their new state, but above all after an abrasive cleaning. Moreover, the inventive sink units can be cleaned more easily and effectively than sink units having "polished" surface areas, in which the microgrooves approximately form circles.

In the case of inventive sink units produced from casting masses, molding compounds and the like, the tool used for their production is provided with the desired surface structure, i.e. ground in the areas of the mold cavity wall in question, so that the surface structure of the mold cavity wall is reproduced on the sink unit surface during the production of the sink units. In principle, the inventive surface design can also be used for sink units which are produced in a different way, e.g. sink units produced from stainless steel sheet metal by deep-drawing; in the last-mentioned case, the sheet metal can be ground prior to the deep-drawing in those areas to be provided with the surface structure and the sheet metal then covered with a foil for deep-drawing so that the inventive surface structure is not impaired or even ruined during the deep-drawing process. In this connection, it is to be noted that sink units produced from stainless steel sheet metal and ground all over the surface are known; for this purpose, the sheet metal is ground over its entire surface prior to deep-drawing, whereupon the ground surface is covered with a plastic foil or sheet and the sheet metal then deep-drawn. However, the disadvantage of this is that the smooth surface areas which are advantageous for the optical impression, above all, of the new sink unit are lacking in such a sink unit.

With respect to the wish to be able to clean the inventive sink unit easily, embodiments are recommended in which the surface roughness measured in the microgroove base in longitudinal direction of the microgrooves is approximately 0.1 μm and, therefore, in the order of magnitude of the surface roughness of the smooth surface areas.

In principle, the preferred direction of the microgrooves could extend in any optional direction of the sink unit; both with respect to appearance as well as to the wish to be able to clean the sink unit as easily as possible, embodiments are, however, recommended, in which the microgrooves extend in longitudinal direction of the sink unit; this leads not only to the fact that the tools required for the production of the sink units are easier to produce but also sink units of this type have a much better appearance and can be cleaned much better than sink units, in which the microgrooves extend in another direction, e.g. transversely to the longitudinal direction of the sink unit—the natural cleaning motion likewise extends in longitudinal direction of the sink unit.

Additional advantageous features and advantages of the invention result from the attached claims and/or the following description as well as the attached drawings of a preferred embodiment of the inventive built-in sink unit; in the drawings:

DETAILED DESCRIPTION OF THE PREFERRED EMBODIMENT

Figure 1:
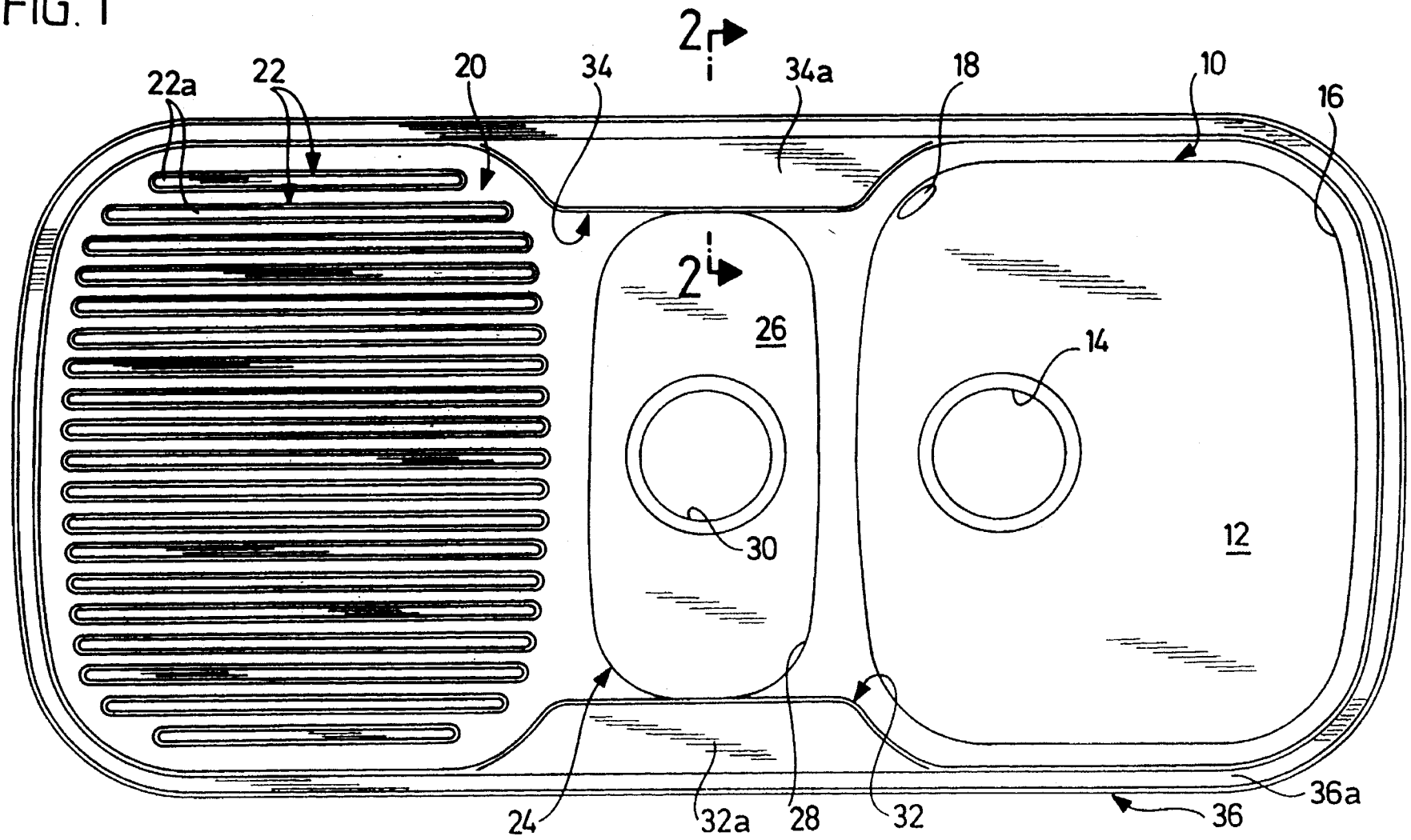
FIG. 1 is a plan view onto this built-in sink unit.

The built-in sink unit illustrated in FIG. 1 has a sink basin 10 with a sink bottom 12, in which an outlet opening 14 is located, and sink side walls 16, in which an overflow opening 18 is located; in addition, this built-in sink unit is provided with a draining surface 20 which has raised longitudinal ribs 22 extending in longitudinal direction of the sink unit. A scraps basin 24 in the form of a small basin having a scraps basin bottom 26, scraps basin side walls 28 and an outlet opening 30 in the basin bottom 26 is located between the sink basin 10 and the draining surface 20. A so-called base for tap fittings is provided both in front of and behind the scraps basin, namely a front base for tap fittings 32 and a rear base for tap fittings 34 which are both raised above the level of the actual draining surface 20 and the upper sides 32*a* and 34*a* of which lie, however, somewhat lower than the upper side 36*a* of a raised rim 36 extending around the built-in sink unit. The upper sides 22*a* of the longitudinal ribs 22 which are, in particular, flat also lie lower than the upper side 36*a* of the circumferential rim 36.

In this preferred embodiment of the inventive built-in sink unit, this is intended to be a sink unit which has been produced from a casting resin incorporating filler materials, whereby the filler materials can be granular or fibrous filler materials.

The bottom 12 of the sink basin, the bottom 26 of the scraps basin, the upper sides 22*a* of the ribs, the upper sides 32*a* and 34*a* of the two bases 32 and 34 for tap fittings as well as the upper side 36*a* of the circumferential rim 36 are intended to have an inventive microgroove structure whereas all the other surface areas on the visible side of the inventive built-in sink unit are intended to be smooth and, in particular, have a surface roughness which is in the order of magnitude of 0.1 μm (again measured at a cut-off value of 0.8 mm). This microgroove structure will be explained in greater detail on the basis of FIG. 2 by way of example.

Figure 2:
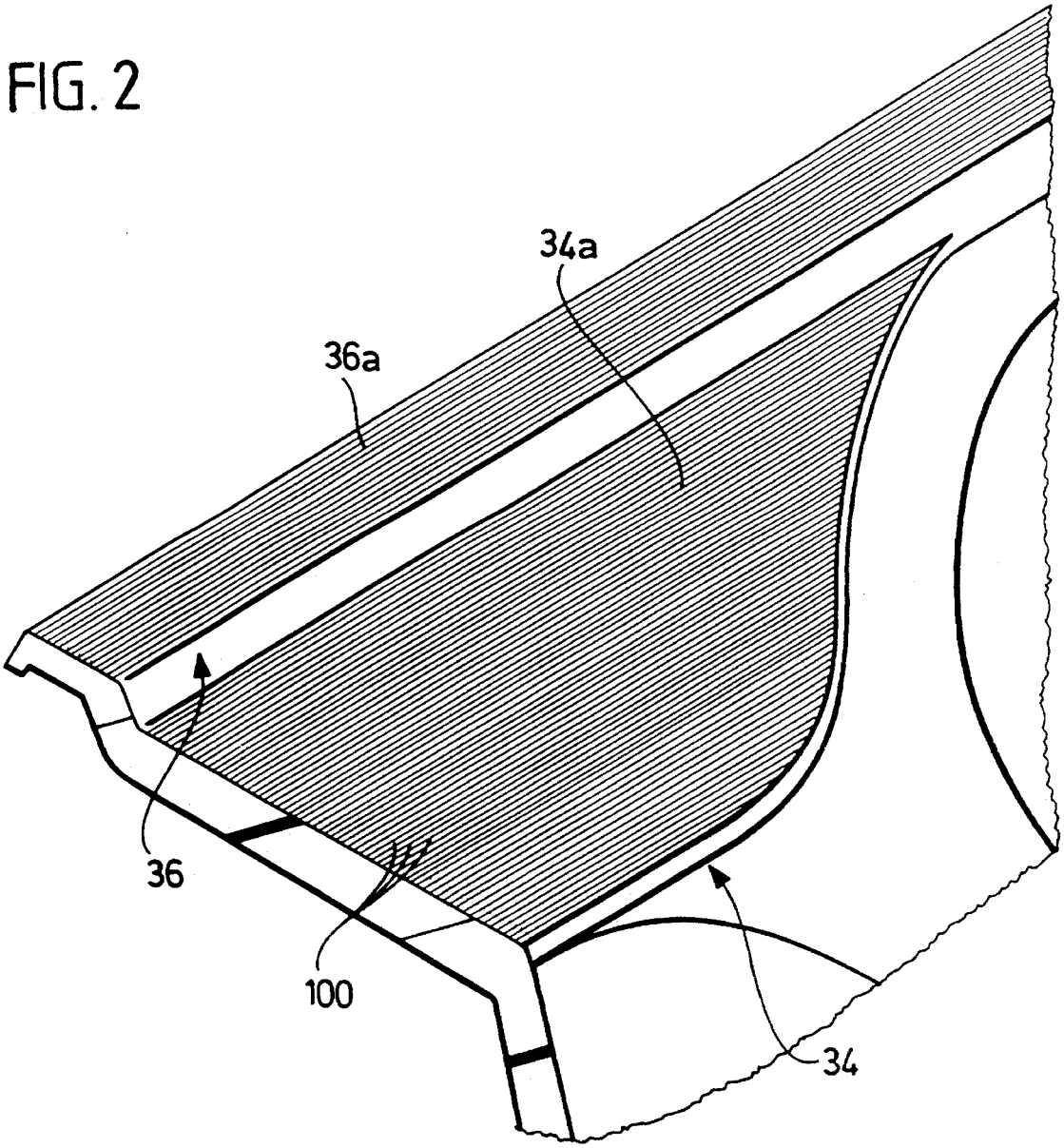
FIG. 2 is a section through a region of this built-in sink unit, namely a section along the line 2—2 in FIG. 1, the inventive surface structure being illustrated on an enlarged scale, i.e. the illustration of the surface structure does not correspond to the actual surface roughness etc.

In FIG. 2, those surface areas which are intended to have the inventive microgroove structure have been provided with a line structure. In accordance with the invention, the microgrooves 100 extend in longitudinal direction of the sink unit; at the microgroove base, the surface roughness measured in longitudinal direction of the microgrooves is intended to be approximately 0.1 μm whereas the surface roughness measured transversely to the longitudinal direction of the microgrooves is intended to be approximately 0.2 μm. All the other surface areas on the visible side of the inventive sink unit are intended to have a surface roughness of approximately 0.1 μm—measured in any optional direction—and, therefore, be smooth within the meaning of the preceding definition, which means that they have a high-gloss surface.

It has been shown that with a surface roughness of somewhat more than 0.1 μm (measured transversely to the longitudinal direction of the microgrooves) the desired effects can already be achieved, whereby it is of advantage with respect to the appearance and the possibility of an effective cleaning for this surface roughness not to exceed a value of 0.4 μm. With regard to the appearance, the visibleness of scratches and the like, as well as the possibility of an effective cleaning, optimum conditions result when the surface roughness measured transversely to the longitudinal direction of the microgrooves is approximately 0.2 μm.

The invention has a particularly advantageous effect in the case of those built-in sink units which are produced from dyed casting or molding materials and have a considerable color saturation.

We claim:

1. A built-in sink unit with at least one basin, comprising first surface areas, subject to severe wear during use as well as second surface areas, subject to less severe wear during use and the first surface areas being provided with a three-dimensional surface structure and the second surface areas being smooth, wherein the surface structure of the first areas is formed by microgrooves at least approximately straight and extending parallel to one another, the surface roughness measured transversely to the longitudinal direction of the microgrooves being greater than 0.1 μm and at the most approximately 0.4 μm.

2. A built-in sink unit as defined in claim 1, wherein the surface roughness of said first surface areas measured transversely to the longitudinal direction of the microgrooves is approximately 0.2 μm.

3. A built-in sink unit as defined in claim 2, wherein the surface roughness of the microgroove base measured in the longitudinal direction of the microgrooves is approximately 0.1 μm.

4. A built-in sink unit as defined in claim 1, wherein the ratio of the surface roughness measured transversely to the longitudinal direction of the microgrooves to the surface roughness measured in the microgroove base in longitudinal direction of the microgrooves is between approximately 1.2 and approximately 2.

5. A built-in sink unit as defined in claim 1 wherein said built-in sink unit consists of casting resin, in particular, incorporating filler material and has been produced with a casting mold, the mold cavity wall thereof having been ground in first wall surface areas corresponding to the first surface areas of the built-in sink unit such that ground microgrooves approximately straight and extending parallel to one another result.

6. A built-in sink unit as defined in claim 1 wherein the first surface areas comprise at least one, of the following surface areas:

(a) bottom of the sink basin;

(b) bottom of a scraps basin;

(c) upper side of ribs of a draining surface;

(d) upper side of at least one base for tap fittings;

(e) upper side of a raised rim extending around the built-in sink unit.

7. A built-in sink unit as defined in claim 1 wherein the microgrooves extend in longitudinal direction of the sink unit.

8. A built-in sink unit as defined in claim 1, wherein the surface roughness of the microgroove base measured in the longitudinal direction of the microgrooves is approximately 0.1 μm.

* * * * *